United States Patent [19]

Mosley

[11] Patent Number: 5,026,258

[45] Date of Patent: Jun. 25, 1991

[54] HIGH-VOLUME AUXILIARY-OVERLOAD-BYPASS VALVE

[76] Inventor: Shawn D. Mosley, 17400 S.E. Decker Road, Boring, Oreg. 97009

[21] Appl. No.: 369,062

[22] Filed: Jun. 19, 1989

[51] Int. Cl.[5] ..... F04B 49/08

[52] U.S. Cl. ..... 417/304; 417/308

[58] Field of Search ..... 417/302, 303, 304, 307, 417/308, 310, 311

[56] References Cited

U.S. PATENT DOCUMENTS

| | | | |
|---|---|---|---|
| 2,358,629 | 9/1944 | Lancey | 417/307 |
| 2,362,724 | 11/1944 | Shea | 417/308 |
| 3,266,426 | 8/1966 | Brunson | 417/302 |
| 3,402,733 | 9/1968 | McAlvay | 417/307 |
| 3,457,941 | 7/1969 | Cook | 417/307 |
| 3,827,827 | 8/1974 | Hill | 417/307 |
| 4,435,127 | 3/1984 | Kranzle et al. | 417/307 |

OTHER PUBLICATIONS

Woodward Gas Turbine Engine Governing Bulletin 40004B, 3/1958, p. 6.

*Primary Examiner*—Leonard E. Smith
*Assistant Examiner*—John A. Savio, III

[57] ABSTRACT

An auxiliary-overload-bypass valve in a fluid-delivery system including a pump having its own internal, relatively low-volume-capacity bypass valve. The auxiliary valve relieves a defined high pressure condition which can occur in the system when the pump is overworking and the system is not delivering fluid. The valve includes a valve body with an inlet coupled to the system downstream of the pump and an outlet coupled to the system upstream of the pump. Disposed inside the body is a valve-opening mechanism for allowing fluid to pass through the valve to relieve the high pressure condition.

4 Claims, 1 Drawing Sheet

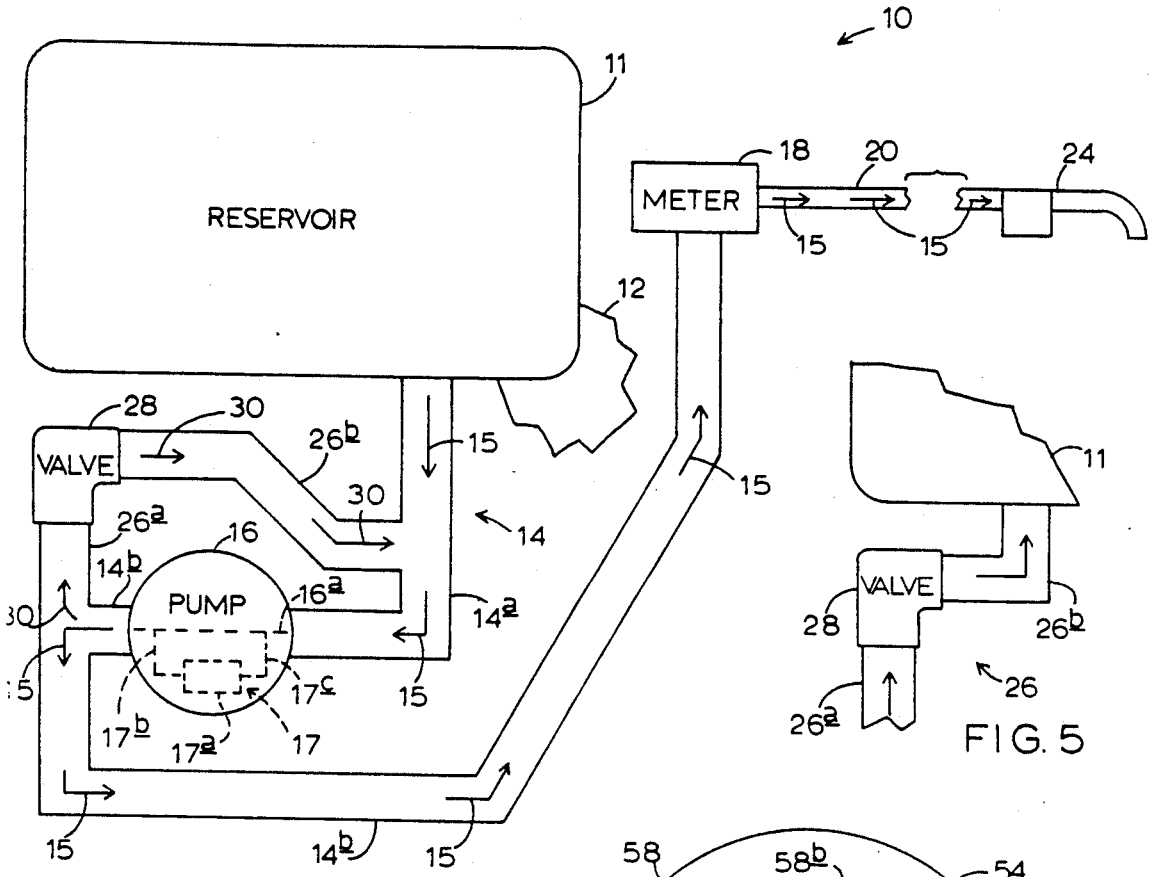
FIG. 1
FIG. 5
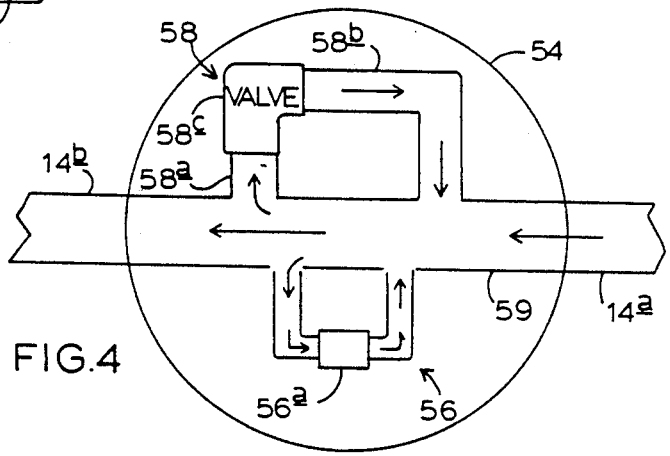
FIG. 4
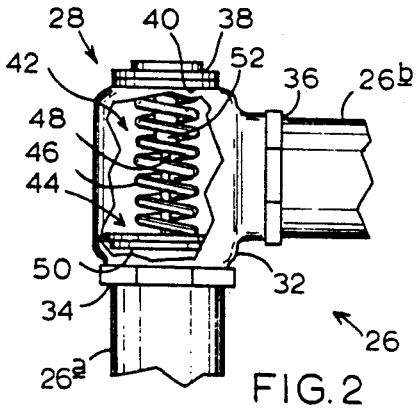
FIG. 2
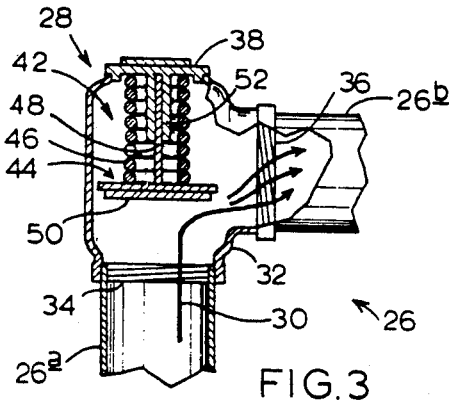
FIG. 3

HIGH-VOLUME AUXILIARY-OVERLOAD-BYPASS VALVE

BACKGROUND AND SUMMARY OF THE INVENTION

This invention relates generally to fluid-delivery systems and more particularly to one including a pump having its own internal, low-volume-capacity bypass valve. Proposed by the invention, in such a system, is a high-volume-capacity, auxiliary-overload-bypass valve for relieving a defined high pressure condition which can occur in the system when the pump is overworking and the system is not delivering fluid—a condition not "protectible" by the pump's internal bypass valve.

Conventional home-heating fuel delivery systems, wherein the invention offers particular utility, are designed for use on a fuel-delivery truck. One end of such a system is coupled to the truck's deliverable fuel supply, and the other end to a delivery nozzle for use by the operator.

Such a system includes fuel plumbing which feeds fuel into a fuel pump, connects an output of the pump to a meter, and couples an output of the meter to a flexible hose which is connected to a delivery nozzle. The pump's speed can be accelerated to an RPM sufficient to pump fuel through the entire system. Increasing the pump's speed produces a full-fuel-delivery-pressure condition in the system so that, once the operator opens the nozzle, fuel is deliverable at a suitable rate.

To operate the pump, the same is coupled to the truck's transmission by way of an auxiliary drive shaft. Then, by increasing the truck-engine RPM, the operator increases the pump's speed to a full-fuel-delivery rate, approximately 600 RPM which produces a full-fuel-delivery pressure of 50–100 psi throughout the system. Given this pressure and the standard two-inch diameter pipe used in conventional systems, such systems deliver fuel at 50–100 gpm.

To deal with certain system-pressure-overload conditions, a conventional system's pump includes an internal-overload-bypass valve designed to relieve system pressure when the pump is operating at full-fuel-delivery speed and the delivery nozzle is closed. These conventional valves allow the system operator to run the pump without having to deliver fuel.

Specifically, the internal-overload-bypass valve is capable of relieving system pressure when the pump is operating at full-fuel-delivery speed, i.e. 600 RPM, producing full-fuel-delivery pressure of 50–100 psi throughout the system. Because conventional overload bypass valves have been designed to deal with the above, so-called, "normal" system pressure, they have been dimensioned to divert fuel at a rate suitable for such a purpose, i.e. 40–50 gpm.

However, conventional systems are not capable of dealing with greater-than-full-fuel-delivery pressure exceeding 100 psi. A common cause of such an extreme condition is failure of the system operator to disengage the auxiliary drive shaft from the truck's transmission after completing fuel delivery and before leaving the delivery site.

With the auxiliary drive shaft engaged while the operator increases the truck-engine RPM to drive the truck, the pump will be overworked. Specifically, the pump's speed will increase to greater than 600 RPM because the operator increases the truck's engine speed to power the truck. This greater-than-full-fuel-delivery speed of the pump causes an extreme pressure build-up in the delivery system of up to several hundred psi. At such extreme pressures, any and all components in the system are likely to rupture because the system pressure exceeds that which the components are rated to withstand.

Not only is the delivery system damaged, but there is also the problem of fuel oil being wasted. Finally, the condition is expensive because several people-hours of cleanup are required.

A proposed solution to the problem has been to provide a system with an electric pump shut-off mechanism. This proposal is flawed in as much as the above-described, extreme pressure build-up and resultant system damage could still occur if the shutoff is defective. In such a case, the operator will not know if the defect exists until it is too late, i.e. until a component of the system ruptures.

Thus, conventional overload-bypass valves are unable to prevent such system failure because they can only handle "normal" system pressure caused by operating the pump at full-delivery speed. Further, conventional internal bypass valves are relatively low-volume valves which are unable to transfer the high volume of fuel at a rate necessary to relieve pressure.

It is therefore a primary object of the present invention to provide a high-volume-capacity auxiliary-overload-bypass valve connected across the pump in such a system for shunting the pump and relieving above-normal system pressure that occurs when the pump is overworking and the system is not delivering fuel.

Another important object of the invention is to provide an auxiliary-overload-bypass valve that can shunt a fuel pump so that fuel is diverted at a rate suitable to relieve greater-than-full-delivery pressure caused when the pump is overworking.

Still another object of the invention is to provide an integrated system as generally described that is easy to operate and simple to incorporate in prior-art systems.

To overcome the problems of the prior art, the system of the present invention includes a auxiliary-overload-bypass valve which can be positioned externally or internally of the pump to provide important backup for the pump's usual internal bypass valve. This auxiliary valve includes a valve body having an inlet connected to a portion of the delivery system downstream of the pump, and an outlet connected to a portion of the system upstream of the pump. Disposed within the valve body is a valve-opening mechanism for relieving system pressure by allowing fuel to pass through the body when the system reaches a greater-than-full-fuel-delivery pressure caused by overworking of the pump.

These and other objects and advantages offered by the present invention will be more clearly understood from a consideration of the accompanying drawings and description of the preferred embodiment.

BRIEF DESCRIPTION OF THE DRAWINGS

FIG. 1 is a schematic diagram of a fuel-delivery system including an auxiliary-overload-bypass valve made in accordance with the present invention.

FIG. 2 is an enlarged fragmentary view of the delivery system of FIG. 1 showing the proposed auxiliary valve with a portion of its exterior broken away.

FIG. 3 is a cross sectional view, somewhat similar to FIG. 2, showing the auxiliary valve in an open condition.

FIG. 4 is a fragmentary schematic view of a modified fuel pump made in accordance with a second embodiment of the present invention, having its exterior broken away to show its interior.

FIG. 5 is a fragmentary view showing a third embodiment of the present invention.

DETAILED DESCRIPTION OF THE PREFERRED EMBODIMENT

Referring to FIG. 1, a delivery system 10 made in accordance with the present invention is shown including a fluid supply, or fuel reservoir 11 mounted on a vehicle or truck, a portion of which is shown at 12. A suitable length of 2-inch-diameter fuel plumbing 14 feeds fuel through the system, in the direction shown by arrows 15, by interconnecting the remaining, yet-to-be-described components of system 10.

Specifically, fuel plumbing segment 14*a* connects reservoir 11 to an inlet of a fuel pump 16. Preferably, pump 16 is a 2 inch positive displacement Blackmer pump, rated at 150 psi. Such a pump is designed to operate at a speed of approximately 600 RPM, i.e. "full-fuel-delivery speed." With pump 16 operating at full-fuel-delivery speed, a "normal" pressure of 50–100 psi exists in system 10.

Pump 16 is connectable conventionally to the truck's transmission (undepicted) via an auxiliary drive shaft (undepicted). Upon connecting the auxiliary drive shaft to the truck's transmission, a delivery-system operator can increase the pump to full-fuel-delivery speed by accelerating the truck's engine (undepicted).

A conventional, spring-loaded, internal-overload-bypass 17 is shown by dotted lines within pump 16, disposed along a fuel path 16*a* also shown by dotted lines. Bypass 17 includes a conventional spring-loaded valve 17*a*, and 1-inch-diameter bypass-plumbing segments 17*b*,17*c*, again shown by dotted lines.

With pump 16 operating at full-fuel-delivery speed, a full-delivery-level-volume of fuel is pumped through an outlet of the pump, in the direction shown by arrows 15, into fuel plumbing segment 14*b* which connects the pump to a meter 18. Given the diameter of fuel plumbing 14, full-delivery-level-volume is 50–100 gpm. Preferably meter 18 is a 2 inch Neptune meter, rated at 150 psi.

From meter 18, fuel flows into a suitable length of 1½ inch diameter, flexible, tank-truck-delivery hose 20, which may be stored on a reel (undepicted) mounted on the truck. A 1¼ inch diameter nozzle 24 is coupled to an end of the hose for directing fuel into a home-fuel tank (undepicted). A suitable length of hose 20 is provided to allow the operator to move the nozzle to the tank.

Still referring to FIG. 1, a novel auxiliary-overload-bypass 26 is shown including 2-inch-diameter, bypass-plumbing segments 26*a*,26*b* that couple the remaining components of system 10 to a novel auxiliary-overload-bypass valve 28. Specifically, segment 26*a* connects fuel plumbing segment 14*b*, disposed downstream of pump 16, to an inlet of valve 28. Segment 26*b* connects an outlet of valve 28 to fuel plumbing segment 14*a* disposed upstream of pump 16.

As will soon be described in detail, valve 28 is moveable from a closed condition to an opened condition. In its closed position, valve 28 prevents fuel from flowing through bypass 26. In its open position, valve 28 allows fuel to flow through bypass 26 in the direction shown by arrows 30.

Turning now to FIG. 2, the structure of valve 28 is shown. Valve 28 includes a valve body 32 having a greater than 2 inch inner diameter, and having 2-inch-diameter inlet and outlet 34,36, respectively. Additionally, the valve includes a cap 38 which is threadable into a threaded bore 40 formed in a top portion of body 32.

Disposed in body 32 is a valve-opening means 42 including a poppet 44 and a spring 46. Poppet 44 includes a stem 48 positioned vertically in body 32 and attached to a center portion of a circular plate 50. Spring 46, the compression axis of which also is positioned vertically in the body, is disposed circumferentially around stem 48 so that one of its ends rests against an inner surface of plate 50 and another end rests against an inner surface of cap 38. In its closed position as shown in FIG. 2, spring 46 is under compression and thus urges plate 50 into circumferential engagement with inlet 34.

Stem 48 is movably disposed in a stabilizing collar 52 which is attached to, and extends downwardly from, an inner surface of cap 38.

Turning now to FIG. 3 valve 28 is shown with valve-opening means 42 in an open position providing a path for fuel to travel through to segment 26*b*. When a defined high pressure condition exists in system 10, i.e. a greater-than-full-fuel-delivery pressure of approximately 125 psi, the fuel under pressure will force stem 48 upwardly into collar 52, thus further compressing spring 46 between plate 50 and an inner surface of cap 38. Spring 46 is constructed so that it will not further compress unless system pressure is approximately 125 psi.

As shown in both FIGS. 2 and 3, body 32 is dimensioned to have a greater volume capacity than inlet 34 and outlet 36. This capacity allows body 32 to deliver a full-fuel-delivery rate of fuel, i.e. 50–100 gpm, to segment 26*b* without requiring that valve-opening means 42 be movable upwardly in body 32 to a position above a top portion of outlet 36.

Turning now to FIG. 4, a second embodiment of the invention is shown including a modified fuel pump 54. Pump 54 is positioned in system 10 in place of, referring back to FIG. 1, pump 16. Also, and again referring back to FIG. 1, bypass 26 is not included in the second embodiment of the invention. The remainder of the second embodiment of the invention is the same as that shown in FIG. 1.

Pump 54 includes an overload bypass 56 and an auxiliary-overload bypass 58 positioned along a fuel path 59. Bypass 56 is a conventional bypass, like bypass 17 of FIG. 1, and includes a conventional spring-loaded bypass valve 56*a*.

Bypass 58 has the same construction as bypass 26, but is disposed inside of pump 54. Thus, bypass 58 includes 2-inch-diameter bypass-plumbing segments 58*a*,58*b* and a novel auxiliary-overload-bypass valve 58*c* that is movable to an open position when system pressure reaches approximately 125 psi.

Finally, turning to FIG. 5, a third embodiment of the present invention is shown wherein system 10 of FIG. 1 is changed to route bypass segment 26*b* to fuel reservoir 11, rather than to segment 14*a*. Thus, fluid exiting valve 28 will flow directly into reservoir 11 via segment 26*b*.

Accordingly, it is now easy to see and understand how the objectives set forth for the invention are attained by the same as described above. To operate the above-described first embodiment of the invention as shown in FIG. 1, pump 16 is connected to the truck's auxiliary drive shaft and the truck's engine is accelerated to increase the pump's speed to approximately 600 RPM, causing the system pressure to reach a "normal" pressure of 50–100 psi. Fuel is thus fed into pump 16 from reservoir 11 via segment 14*a* and pumped out of the same into segment 14*b*. Fuel flows in the direction of arrows 15 through meter 18 and into hose 20 where it is delivered to a home-fuel tank through nozzle 24.

With the nozzle closed and the pump operating at full-fuel-delivery speed, which produces a "normal" system pressure, conventional internal bypass 17 will relieve system pressure.

If, after completing fuel delivery, the operator leaves the delivery site without disengaging the truck's auxiliary drive shaft from the pump, auxiliary-overload-bypass 26 shunts the pump to relieve greater-than-full-fuel-delivery pressure, i.e. 125 psi. This pressure is caused by the pump being overworked when the truck's engine RPM is increased to power the truck. With its bypass segments 26*a*, 26*b*, and its high-volume capacity valve 28, bypass 26 is structured to transfer a high volume of fuel and is thus capable of relieving greater-than-full-fuel-delivery pressure that conventional, internal-overload bypasses are not structured to handle.

The above-described second embodiment of the invention as shown fragmentarily in FIG. 3, accomplishes the same above-described objectives by including both a conventional, low-volume overload bypass, and a high-volume auxiliary-overload-bypass positioned inside a modified pump. The conventional bypass relieves system pressure when the operator runs the pump at full-fuel-delivery speed with the system's nozzle closed. The auxiliary-overload-bypass shunts the pump to relieve greater-than-full-delivery pressure.

While a preferred embodiment of the invention has been described herein, it is appreciated that further modification are possible that come within the scope of the invention.

It is claimed and desired to secured by letters patent:

1. A vehicle-carried liquid-fuel-delivery system, comprising a vehicle including an auxiliary drive shaft, a fuel reservoir, a fuel pump being operatively connectable to said auxiliary drive shaft and including an overload bypass valve effective to shunt the pump when output fuel pressure exceeds a first predetermined level, an extreme-pressure-damage-protection, auxiliary-overload-bypass valve operatively connected across said pump, and operable to shunt the pump when output fuel pressure exceeds an extreme, second predetermined level which is greater than such first predetermined level, and which is due to the auxiliary drive shaft remaining connected to said pump while the vehicle is driven, said auxiliary-overload-bypass valve thus being operable to protect said system from extreme-pressure damage that can occur due to such auxiliary-drive-shaft-/pump connection existing when the vehicle is driven.

2. The system of claim 1, wherein said auxiliary overload-bypass valve is external to said pump.

3. The system of claim 1, wherein said auxiliary-overload-bypass valve is connected to direct fuel into said reservoir.

4. The system of claim 1, wherein said auxiliary-overload-bypass valve is inside of said pump.

* * * * *

UNITED STATES PATENT AND TRADEMARK OFFICE

CERTIFICATE OF CORRECTION

PATENT NO. : 5,026,258

DATED : June 25, 1991

INVENTOR(S) : Shawn D. Mosley

It is certified that error appears in the above-identified patent and that said Letters Patent is hereby corrected as shown below:

On the cover page please add the following immediately underneath "Assistant Examiner--John A. Savio, III":

Attorney, Agent, or Firm--Kolisch, Hartwell, Dickinson, McCormack & Heuser

Signed and Sealed this

Third Day of November, 1992

*Attest:*

DOUGLAS B. COMER

*Attesting Officer*

*Acting Commissioner of Patents and Trademarks*